US005788516A

United States Patent [19]

Uggmark

[11] Patent Number: 5,788,516

[45] Date of Patent: Aug. 4, 1998

[54] ELASTOMERIC CONNECTOR

[75] Inventor: Johan Georg Michael Uggmark, Lund, Sweden

[73] Assignee: Telefonaktiebolaget LM Ericsson, Stockholm, Sweden

[21] Appl. No.: 722,032

[22] PCT Filed: Mar. 30, 1995

[86] PCT No.: PCT/SE95/00338

§ 371 Date: Dec. 3, 1996

§ 102(e) Date: Dec. 3, 1996

[87] PCT Pub. No.: WO95/27323

PCT Pub. Date: Oct. 12, 1995

[30] Foreign Application Priority Data

Apr. 5, 1994 [SE] Sweden ..... 9401116

[51] Int. Cl.[6] ..... H01R 4/58

[52] U.S. Cl. ..... 439/86; 439/63

[58] Field of Search ..... 439/86, 91, 63

[56] References Cited

U.S. PATENT DOCUMENTS

| | | | |
|---|---|---|---|
| 3,852,878 | 12/1974 | Munro | 29/629 |
| 4,003,621 | 1/1977 | Lamp | 439/586 |
| 4,118,092 | 10/1978 | Sado et al. | 439/91 |
| 4,408,814 | 10/1983 | Takashi et al. | 439/91 |
| 4,639,062 | 1/1987 | Taniguchi et al. | 439/74 |
| 4,754,546 | 7/1988 | Lee et al. | 439/86 |
| 5,013,249 | 5/1991 | Lindemann et al. | 439/66 |
| 5,259,770 | 11/1993 | Bates et al. | 439/66 |

FOREIGN PATENT DOCUMENTS 42 09 097 9/1993 Germany .

OTHER PUBLICATIONS

Abstract of German document DE 42 09 097.

*Primary Examiner*—Gary F. Paumen
*Assistant Examiner*—T. C. Patel
*Attorney, Agent, or Firm*—Burns, Doane, Swecker & Mathis, L.L.P.

[57] ABSTRACT

An elastically deformable, elastomeric connector (10) has electrically conductive elements (11*a*, 11*b*) extending in parallel between opposite ends of said connector (10). A first conducting path (13) is formed by a first set of electrically conductive elements (11*a*, 11*b*) and is substantially surrounded by a second conducting path (14) formed by a second set of electrically conductive elements connected to ground, thereby providing a shielding of said first path.

13 Claims, 3 Drawing Sheets

ELASTOMERIC CONNECTOR

TECHNICAL FIELD

The present invention relates to an elastically deformable, elastomeric, electrical connector having electrically conductive elements extending in parallel between opposite ends of said connector.

The invention also relates to a use of the elastomeric connector for mounting and electrically connecting a piece of radio communication equipment with an electrical circuit.

BACKGROUND OF THE INVENTION

Radio communication apparatuses such as mobile telephones always comprise at least one microphone unit and one hearing capsule or speaker. The assembly of for example a microphone requires the following demands to be fulfilled: vibrations, scratches and noise entering the plastic cover of for example a mobile telephone must be absorbed; speech entering the cover from the speaker, which is mounted in the same cover, needs to be absorbed in order to avoid echo effects; an electrical connection has to be achieved between the microphone and the PCB (Printed Circuit Board); occurring TDMA (Time Division Multiplexing Access) hum has to be suppressed; high production flow and yield together with favourable cost-efficiency should be accomplished.

Today the most common way to connect a microphone is to solder two wires between the microphone and the PCB which carries the amplifier. Subsequently, the microphone is placed in a rubber gasket which can absorb the disturbances mentioned above. However, soldering has the disadvantage of being difficult to automatize since in this case soldering has to be made by hand. Consequently, the production rate is slowed down and undesired costs are taken. There is also a certain risk for mixing the wires with each other.

In order to facilitate the soldering, the wires must be long enough. However, this may cause problems at the final assembly, since there is a risk that a long wire may be pressed between mechanical parts, such that the leads are either cut off or shortened to an undesirable signal, e.g. ground.

Another metod to connect a microphone is to solder one end of a piece of flex film to the microphone, whereupon the other end thereof is soldered or pressed onto is connection pads on the PCB.

U.S. Pat. No. 5,205,751 discloses an electrically conductive, elastomeric connector for electrically connecting a portion of a first substrate with a portion of a second substrate, said connector having a tubular shaped body with first and second claw arms. No soldering is needed, since the elastically deformable connector is fixed into position by compressing it between the two substrates.

In order to suppress the TDMA hum, which is frequently occurring especially in GSM terminals, a capacitor has to be soldered directly on the microphone. As a consequence the microphone becomes more expensive and the sensitivity thereof is decreased since it is heated during soldering.

U.S. Pat. No. 5,200,717 discloses an apparatus for interconnecting and shielding active electrical circuitry, wherein an electrically conductive elastomer material is used instead of metal for the purpose of shielding and at the same time has the advantage of being compressible.

It is obvious that none of the prior art is capable of meeting all the requirements stated above.

THE INVENTION

The object of the present invention is to provide a method of shielding and electrically connecting a piece of radio communication equipment with an electrical circuit. According to the invention this object can be achieved by means of the elastically deformable, electrically conductive, low-resistance, elastomeric connector.

Another object of the present invention is to accomplish a method of absorbing vibrations and noise entering the radio communication equipment.

A further object of the present invention is to provide a method of mounting a microphone in radio communication equipment without needing to mount a capacitor directly on the microphone in order to suppress TDMA hum.

Yet another object of the present invention is to accomplish a method of assembling a piece of radio communication equipment which permits high production flow and yield at a low cost.

Still another object of the present invention is to accomplish a method of assembling which permits increased miniaturization of radio communication equipment.

In order to obtain the objects mentioned above it is further suggested according to the invention, to use the elastomeric connector.

THE DRAWINGS

Preferred embodiments of the invention will be described in more detail below, reference being made to the accompanying drawings, in which FIG. 1 is a perspective view of a first embodiment of the elastomeric connector according to the invention, FIG. 2 is a perspective view of a second embodiment of the elastomeric connector according to the invention, FIG. 3 is a cross sectional view of a mounting of a microphone with the elastomeric connector according to FIG. 2, FIG. 4 is an end view of the mounting of an elastomeric connector with the microphone according to FIG. 3, FIG. 5 is a cross sectional view of an alternative mounting of the microphone by means of the elastomeric connector according to FIG. 2, FIG. 6 is an end view of the alternative mounting of an elastomeric connector with the microphone according to FIG. 5, FIG. 7 is a cross sectional view of a second alternative mounting of the microphone by means of the elastomeric connector according to FIG. 2, FIG. 8 is an end view of the second alternative mounting of an elastomeric connector with the microphone according to FIG. 7, FIG. 9 is a cross sectional view of a third embodiment of the elastomeric connector according to the invention, and FIG. 10 is a perspective view of a fourth embodiment of the elastomeric connector according to the invention.

DESCRIPTION OF EMBODIMENTS OF THE INVENTION

Figure 1:
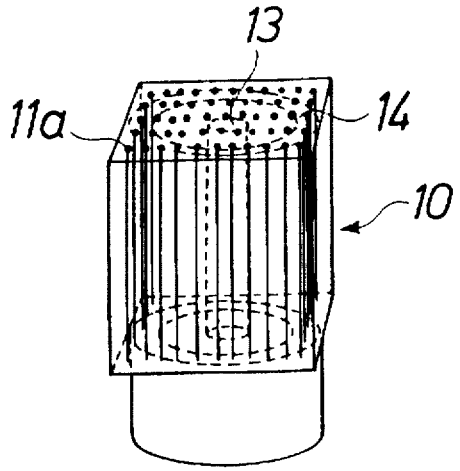

FIG. 1 shows an elastically deformable, electrically conductive, low-resistance elastomeric connector 10 comprising an elastomeric material filled with spaced apart metal wires 11a having high conductivity, preferably made of gold or goldplated metal. A useful property of such conductive elastomers is that they contain a plurality of minute conductors that conduct linearly through the material without conducting laterally within the material.

The elastomeric connector may have any shape, e.g circular, rectangular etc.

By shortcircuiting the respective ends of said connector the conducting wires made of conducting material together form conductors extending in parallel from a first end of the connector to a second end thereof. If said ends are shortcircuited by an annular member the wires together form one conducting path. Normally, electrical units are connected to electrical circuits and other units by two or more paths. One path may provide a shielding of the second path. Such a "twin lead" connection can be achieved according to the invention. If further paths are desired, more annular members may be added.

Figure 2:
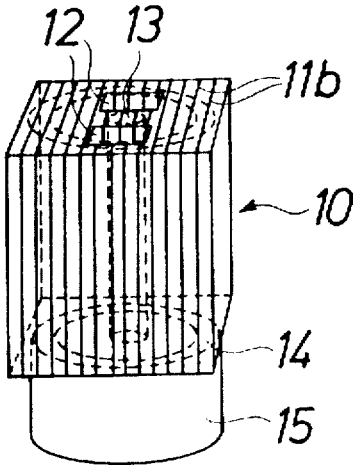

FIG. 2 shows a second embodiment according to the invention of an elastically deformable, electrically conductive, low-resistance, elastomeric connector 10 which is constituted of alternating conducting layers or slices lib and non-conducting intermediate slices, wherein all slices preferably are made of silicon. According to this embodiment two or more apertures 12 are stamped out of the elastomeric connector 10. Said apertures are through holes extending in parallel with said conducting slices **11*b*. Both apertures 12 interupt at least one common slice 11*b*, thereby forming an island of at least one cut off slice therebetween. The cut off slice is used as a first conducting path 13 for connecting a first electric means to a first conducting element or pad on a second electric means or a circuit board. A second conducting path 14 is formed by engaging the elastomeric connector 10** to a second substantially annular conducting element enclosing or surrounding the cut off slice.

Preferably said second conducting element is connected to ground, thereby forming a shield around the cut off slice. The shield is effective in all directions even though no conducting layers exist in some planes parallel to a line connecting said apertures or if the annular shape of said second conductive element is partly interrupted.

Figure 3:
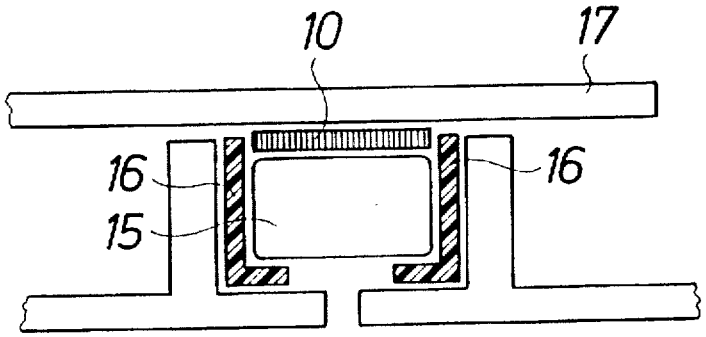
Figure 4:
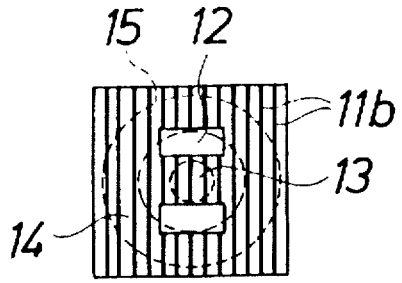

FIGS. 3 and 4 show an example of the assembly of a piece of radio communication equipment such as a microphone 15, buzzer, hearing capsule etc in a mobile telephone, wherein the microphone is arranged in a rubber gasket 16. The elastomeric connector 10 having two apertures is provided between the rear side of the microphone and a substrate, preferably in the form of a PCB 17, where it is fixed into contact with one center connection pad and one peripheral connection pad on the microphone and correspondingly on an electrical circuit of the PCB by mechanically compressing the elastomer to an extent of about 7–12%. The center first conducting path 13 in this case is constituted by five slices or cut off planes. All other layers of the connector together form the second conducting path 14 which constitutes a shield for the center first conducting path 13.

One connection pad on the microphone and one on the circuit board are both connected to said center first conducting path 13. A second annular connection pad on the microphone and one on the circuit board are both connected to said second conducting path 14, said annular connection pads forming a short circuit of the layers together forming the second conducting path. The elastomeric connector 10 is provided with the conducting layers lib oriented in a direction perpendicular to the PCB 17.

Figure 5:
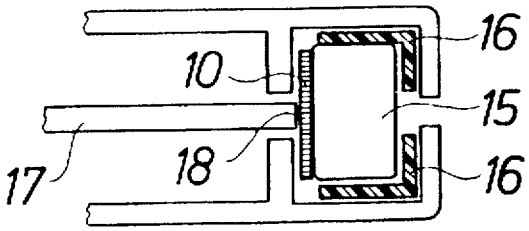
Figure 6:
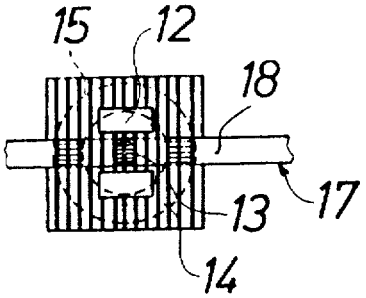

It is sometimes desirable that a microphone 15 or a buzzer etc is mounted in a direction perpendicular to the PCB 17, thus making the sound input from the bottom of the telephone or the sound output from the top of the telephone available, as illustrated in FIGS. 5 and 6. In such cases the connection pads on the PCB are provided on an edge portion 18 thereof. The elastomeric connector 10 is arranged with its conducting layers 11b oriented in a direction perpendicular to the edge portion 18.

Figure 7:
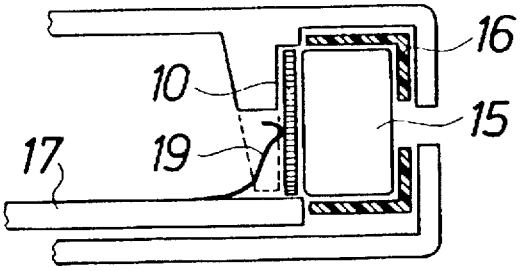
Figure 8:
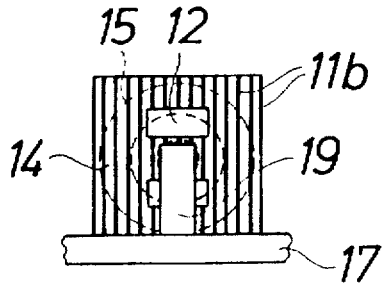

A further example of mounting a microphone 15 or buzzer perpendicular to a PCB 17 is shown in FIGS. 7 and 8. In this case a spring contact 19 soldered to the PCB forms an electrical connection between the PCB and the elastomeric connector 10, which is connected to the microphone or buzzer. The ground signal from the microphone or buzzer is connected through the elastomer directly to connecting pads on the PCB. In order to obtain ground connection the conducting layers of the elastomeric connector must be oriented in such a way that the alternating layers of conductive and non-conductive silicone are perpendicular to the PCB.

Figure 9:
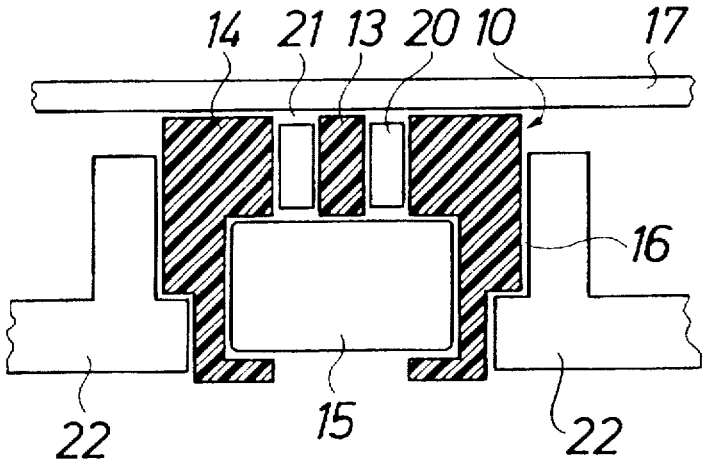

A third embodiment of the elastomeric connector according to the present invention is shown in FIG. 9. In this case an elastomeric connector 10 is manufactured by moulding an electrically conductive elastomer, for example silicon containing silver or copper pellets. A gasket 16 is formed as an integral part of the elastomeric connector which comprises a central cylinder, forming the first conducting path 13 surrounded by a coaxial tube, forming the second conducting path 14 with an insulator 20 provided in a gap 21 between the two parts of electrically conducting elastomer. This solution has several advantages in that the elastomer provides an electrical conductor, a shield, a holder for a microphone or buzzer as well as a gasket. As an alternative (not shown herein) the gasket 16 can be formed as a cylinder of non-conducting elastomeric material, which receives the microphone therein, said microphone then being connected to a PCB by means of an electrically conductive elastomeric connector.

As shown in FIG. 9, the front end of the elastomeric connector 10 may optionally be located on the outside of the cover 22 of a radio communication apparatus. As a result, when the apparatus is placed on an even surface, the microphone sound input is completely plugged. This is a common way to deal with the problem of acoustic instability.

Figure 10:
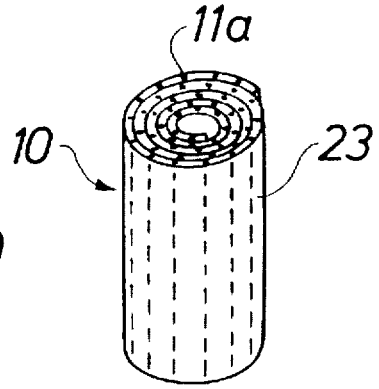

FIG. 10 shows a fourth embodiment of the present invention, wherein the elastomeric connector comprises an elongated sheet 23 of elastomeric material having one or more layers of spaced apart conducting metal wires **11*a*. The elongated sheet is then rolled up into a roll and may then be connected to a microphone 15, thus forming first and second conducting paths 13, 14**.

The elastomeric connector according to the present invention offers several advantages over the prior art including: excellent absorption of vibration and speach; good electrical contact; good shielding from radiated HF; no capacitor needs to be soldered on the microphone; improved compact design possible; high production flow and yield; favourable economy.

While the present invention has been described in connection with the preferred embodiments shown in the figures, it will be apparent to those skilled in the art that various other modifications and substitutions can be made. Accordingly, it is understood that the present invention has been described by way of illustration and not limitation.

I claim:

1. An elastically deformable, elastomeric, electrical connector comprising:

electrically conductive elements extending in parallel between opposite ends of said connector;

a first conducting path formed by a portion of the electrically conductive elements;

a second conducting path which substantially coaxially surrounds the first conducting path and is formed by a set of the electrically conductive elements that may be connected to ground to provide a shielding of the first path;

alternating conductive slices and intermediate non-conducting slices, said conducting slices defining said electrically conductive elements, at least one of said conducting slices being interrupted by at least two apertures in the form of through holes extending parallel with said conducting slices to thereby form said first conducting path located in a central part of the interrupted slice and the second conducting path, the first conducting path being conductively independent of the second conductive path, the second conducting path connectable to ground by engaging the elastomeric connector to an annular conducting element surrounding the interrupted slice.

2. An elastomeric connector according to claim 1, wherein the first conducting path is connectable to a central conducting pad on a substrate and the second conducting path is connectable to an annular conducting pad on the substrate.

3. An elastomeric connector according to claim 1, wherein the electrically conductive elements include spaced apart wires.

4. An elastomeric connector according to claim 3, wherein the metal wires are gold or goldplated metal wires.

5. An elastomeric connector according to claim 1, further comprising a cylindrical gasket of elastically deformable, electrically conductive material forming an outer part of the elastomeric connector, said gasket receiving in a first open end electrical means to be connected by the connector, and in a second end having said electrically conductive elements.

6. An elastomeric connector according to claim 1, further comprising an elongated sheet of elastomeric material comprising one or more layers of spaced apart conducting metal wires arranged in parallel, said sheet being rolled up into a roll, thereby forming said first and second conductive paths.

7. An elastomeric connector according to claim 1 in combination with a piece of radio communication equipment having an electrical circuit, said piece of radio communication equipment being arranged in a rubber gasket and electrically connected with a circuit path of an electrical circuit on a substrate by the elastomeric connector.

8. An elastomeric connector in combination with a piece of radio communication equipment according to claim 7, wherein the piece of radio communication equipment and the elastomeric connector are arranged in a direction perpendicular to the substrate, said substrate having connection pads provided on an edge portion thereof.

9. An elastomeric connector in combination with a piece of radio communication equipment according to claim 7, wherein the piece of radio communication equipment and the elastomeric connector are arranged in a direction perpendicular to the substrate, said substrate having a spring contact soldered thereto which is electrically connected to the elastomeric connector.

10. An elastically deformable electrical connector comprising:

a first and second end;

alternating electrically conductive elements and non-conductive elements extending between the first and second ends of said connector;

a first aperture and a second aperture extending from the first end to the second end, said first aperture interrupting a set of said conductive elements, said second aperture also interrupting said set of conductive elements, said first and second apertures defining a first conducting path and a second conducting path, the first conducting path formed by a portion of the set of conductive elements that is located between said apertures, said second conducting path located external of said portion.

11. The elastically deformable electrical connector according to claim 10, wherein said first and second ends of said connector oppose one another.

12. The elastically deformable electrical connector according to claim 10, wherein said alternating electrically conductive elements are strips of parallel conductive material.

13. The elastically deformable electrical connector according to claim 12, wherein said apertures extend parallel to said strips.

* * * * *